United States Patent [19]

Carré et al.

[11] Patent Number: 4,490,102

[45] Date of Patent: Dec. 25, 1984

[54] VOLUMETRIC SCREW COMPRESSOR

[75] Inventors: Jean-Jacques Carré, Le Raincy; Pierre Courbot, Villiers le Bel; Roland Levrai, Stains, all of France

[73] Assignee: Societe Anonyme D.B.A., Paris, France

[21] Appl. No.: 512,827

[22] Filed: Jul. 11, 1983

[30] Foreign Application Priority Data

Jul. 22, 1982 [FR] France ..... 82 12803

[51] Int. Cl.[3] ..... F04C 18/16

[52] U.S. Cl. ..... 418/201; 418/178

[58] Field of Search ..... 418/201-206, 418/152, 178, 179

[56] References Cited

U.S. PATENT DOCUMENTS

| | | | |
|---|---|---|---|
| 1,233,599 | 7/1917 | Nuebling | 418/201 |
| 2,659,239 | 11/1953 | Nilsson | 74/395 |
| 3,139,834 | 7/1964 | Blomgren | 418/152 |
| 3,182,900 | 5/1965 | Thorson | 418/206 |
| 3,857,682 | 12/1974 | White | 418/178 |
| 4,039,296 | 8/1977 | Levinstein | 418/178 |

FOREIGN PATENT DOCUMENTS

| | | |
|---|---|---|
| 2520667 | 11/1976 | Fed. Rep. of Germany . |
| 1110645 | 2/1956 | France . |
| 1318591 | 1/1963 | France . |
| 1532606 | 7/1968 | France . |
| 2027192 | 9/1970 | France . |
| 2091537 | 1/1972 | France . |
| 2097285 | 3/1972 | France . |

*Primary Examiner*—Leonard E. Smith
*Assistant Examiner*—Jane E. Obee
*Attorney, Agent, or Firm*—Larry J. Palguta; Ken C. Decker

[57] ABSTRACT

The compressor, with rotating assemblies of low inertia, and of compact construction, comprises, housed in a housing, two hollow rotors (5, 6), for example out of plastic material, fixed respectively on a front shaft member (20, 21) journalled in a front bulkhead (26) and each supported at the rear by a rear bearing assembly (11) fixed to a rear end wall (2) of the housing and entirely contained within the internal space (7, 7) in the rotor. The drive is provided by the female rotor (6). The inner surfaces of the housing and the outer surfaces of the rotor threads are coated with an overthickened layer of an erodable coating material containing particles of a dry lubricant material.

13 Claims, 3 Drawing Figures

VOLUMETRIC SCREW COMPRESSOR

The present invention relates to compressors and, more particularly, volumetric compressors or blowers of the screw type.

Screw compressors usually incorporate at least one meshing pair of parallel rotors with helical threads rotating in synchronism, by means of timing e.g. driving gears, in two cylindrical chambers which intercommunicate longitudinally. This type of compressor, generally of robust design, is used in industrial applications to supply pressures of the order of several bars per stage. For this reason the rotors are usually machined from a single piece with their driving and supporting shafts or, as described for example in French Pat. No. 1,243,471, have a hollow hub and are each mounted on an unitary long shaft which projects axially from both of the longitudinal ends of the rotors to form journals for bearings in the housing and to enable timing gears to be fitted. In all cases, rotors of this type possess considerable inertia, usually accentuated by the number of helical threads in order to obtain high pressure ratios, so that the compressor is driven by the principal or male rotor with thick thread bodies, which performs the greater part of the work of compression.

An object of the present invention to provide a screw compressor designed to supply low positive pressures, less than 1 bar, of particularly compact construction, with internal rotating assemblies of low inertia, achieving a good volumetric efficiency, especially at low speeds, and suitable for mass production, especially for use in the field of volumetric supercharging of combustion engines, more particularly for automotive vehicles.

In order to meet this object and others, according to a feature of the invention, the screw compressor, of the type comprising a casing defining two parallel cylindrical chambers which intercommunicate longitudinally and are closed at one end by a rear end wall of the casing, and with fluid inlet and exhaust ports which communicate with the chambers, two helically threaded rotors each with a hollow hub supported and driven in rotation by a shaft means comprising a first end journalled in a front bulkhead fitted to the front of the casing and closing the two chambers opposite said rear end wall, these first ends being coupled by meshing toothed wheels, is characterized in that each rotor hub is formed with a longitudinally extending traversing inner space, each shaft means incorporates a rear bearing assembly housed within the corresponding end of the rotor hub space and sealingly mounted on a shaft member fixed to the rear end wall of the casing, and a front shaft member, extending through said front bulkhead, secured to the corresponding rotor and extending innerly into the front portion of said inner space of the rotor hub.

With such an arrangement, each rotor is hollow and the shaft line of each rotor is thus broken into two separate end portions, thus enabling the inertia of each rotating assembly to be considerably lowered and the axial dimension of the compressor can be reduced due particulaly to the rear bearing assembly being housed entirely within the traversing inner space of the rotor hub. As a result of the thus achieved low inertia of the rotating assemblies, which may be further reduced by making the rotors out of plastic material advantageously directly molded upon the front shaft member, according to another feature of the invention, which participates in the reduction of the dimensions of the compressor, the drive motion is applied to the female rotor, which thus causes an increase, proportional to the ratio of the number of teeth of the driving gears for the male rotor and the female rotor, in the rotational speed of the male rotor, and hence of the swept volume of the compressor per revolution.

According to another feature of the invention, in a volumetric screw compressor, of the type embodying a male rotor and a female rotor housed respectively in two parallel intercommunicating chambers formed in a housing and closed, at their opposite axial ends, by a rear end wall and a front end wall, each rotor being supported and driven in rotation by a shaft means including a first shaft end extending through said front end wall, said first shaft ends being provided with meshing toothed wheels for synchronous driving of the rotors, at least the inner walls of said chambers, and advantageously also the surfaces of the rotor threads, are coated with an overthickened layer of an erodable coating material containing particles of a dry lubricant material, said driving toothed wheels being mutually coupled without angular play.

With such an arrangement, the compressor can be easily and quickly assembled, the plays resulting from tolerance variations being limited and the ulterior problems of mutual angular setting of the rotors being substantially suppressed, whereby permitting a mass production suitable notably for the automotive vehicles.

Other features and advantages of the present invention will emerge from the following description of an embodiment, given by way of illustration but not limiting in any way, with reference to the accompanying drawings, in which.

Figure 2:
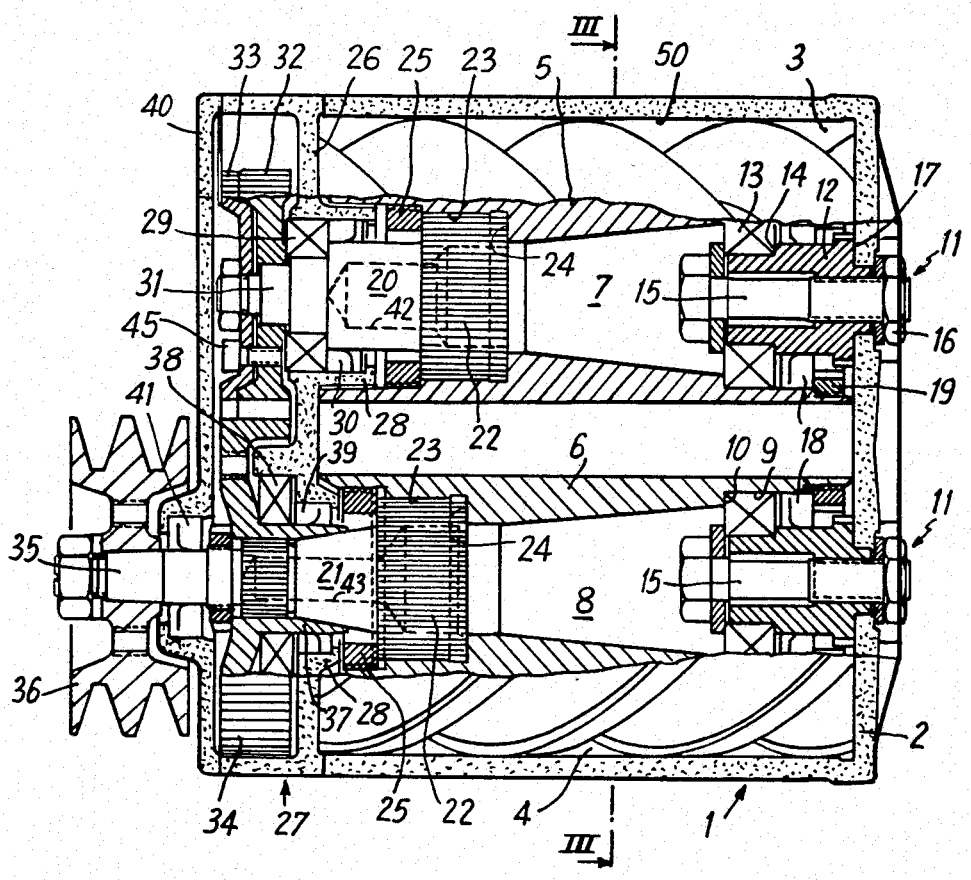
FIG. 2 is a similar view but sectioned longitudinally.

As illustrated in the drawings, a compressor according to the invention comprises a body housing 1, substantially of a parallelepipedic shape, open at one end and closed at the other end by a rear end wall 2, the body housing 1 defining two parallel cylindrical chambers 3 and 4 which intercommunicate longitudinally. Chambers 3 and 4 house respectively a male rotor body 5 and a female rotor body 6. In the embodiment shown, the male rotor body 5 has four helical threads, and the female rotor body has six helical threads. The male rotor body 5 and female rotor body 6 are hollow and are each traversed by a longitudinal inner space 7 and 8, respectively, which terminates at the rear end in a cylindrical bearing surface 9 forming an internal shoulder 10 and intended to house a rear bearing assembly 11 fixed to the rear end wall 2. Each rear bearing assembly 11 incorporates a tubular pin 12 on the front end of which is mounted a bearing 13 whose inner race is held against a shoulder 14 of the pin by the head of a screw 15 whose threaded end, which is screwed into the hollow pin 12, projects outwardly beyond the rear end wall 2 to carry a nut 16 which, in the embodiment shown, ensures that the rear bearing assembly 11 is secured to this rear end wall 2, against the inner face of which an end shoulder 17 of the shaft member or pin 12 bears. The rear bearing 13 of each rotor 5 or 6 is thus positioned inside the latter, between the internal bearing surface 9 and the shaft member 12 which is itself mounted so as to overhang from the rear end wall 2 by means of the screw 15 which passes right through it. As shown in FIG. 2, a seal 18 is also positioned between the shaft component 12 and the internal seat 9, inside the inner space of the rotor, this seal being held in axial position, for example by a ring 19 screwed into a thread formed at the end of the smooth internal bearing surface 9.

Further in accordance with the invention, the male and female rotor bodies 5 and 6 are each fixed at their front ends onto a front shaft member 20 and 21, respectively. Each front shaft member 20, 21 comprises an end portion or head of enlarged diameter 22 provided for instance with peripheral splines, which is press fitted, in the embodiment shown, into an enlarged cylindrical mounting portion 23 in the front end portion of the internal space 7 or 8 defining an abutment shoulder 24 facing outwardly, against which the enlarged head 22 of the shaft member 20 or 21 bears. In the embodiment shown, the enlarged head 22 of the shaft components 20 or 21 is held in the corresponding rotor body by a locking ring 25 screwed into a thread formed in the front end portion of the internal space 7 or 8 of the rotor body.

The chambers 3 and 4 are closed, at the front end, by a front bulkhead 26 which may be integral with a front casing 27 defining the housings for the timing gears. The front bulkhead 26 incorporates a tubular projecting portion 28 which extends axially into the enlarged front end portion of the internal space 7 of the male rotor body 5 and forms a smooth bearing surface for a bearing 29 and an annular seal 30 mounted on the front shaft member 20, whose outer end portion 31 projects towards the front, beyond the front bulkhead 26, for mounting two coaxial pitch adjustable toothed wheels 32 and 33 for compensating the angular backlash as required to prevent any driving contact engagement between the rotor threads of the rotor bodies 5 and 6. The wheels 32, 33 mesh with a toothed driving wheel 34 fixed on the end portion 35 of the shaft component 21 of the female rotor 6 projecting towards the front beyond the bulkhead 26 and extended, in this direction, to carry a pulley 36 intended to be coupled to the motive device for driving the compressor. Wheel 33 is angularly adjusted relative to wheel 32 to eliminate any lash between the teeth of driving wheel 34 and driven wheels 32, 33. Wheels 32, 33 include typically a curved slot and a threaded round hole for receiving bolt 45 which is tightened to fix wheel 33 relative to wheel 32. In the embodiment shown, the driving toothed wheel 34 is provided with a hub 37 mounted on the shaft member 21 and on which is mounted a bearing 38 and an annular seal 39 which bear externally on corresponding bearing surface formed by the bulkhead 26, at least the bearing zone for the seal 39 being at least partially contained within the front end portion of the internal space 8 of the rotor 6. The housings for the toothed timing wheels 34 and 32–33 are closed by a front cover 40, an annular seal 41 being positioned between a bearing surface in this front cover 40 and the end portion 35 of the front shaft member 21 of the female rotor 6. It will be noted, particularly in relation with the male rotor 5, that the front seals (30 and 39) are substantially wholly contained within the interior space of the casing defined by the front bulkhead 26. The ratio of the pitch diameters of the toothed timing wheels 34 and 32, 33 is the same as the ratio of the number of helical threads on the rotors 5 and 6. In the arrangement according to the invention, the driving being provided by the female rotor 6, via the leading toothed wheel 34, there follows an increase of 50% in the speed of rotation of the male rotor 5, which gives, for an input rotational speed at the pulley 36 of e.g. 15,000 revolutions per minute, a rotational speed of the male rotor 5 of 22,500 revolutions per minute, which is permissible owing to the reduction of inertia of the rotating assemblies. In order to reduce still further this inertia, as may be seen in FIG. 2, the front shaft members 20 and 21 are advantageously partially hollow and are formed innerly with internal spaces 42 and 43, respectively, these shaft members being made, for example, by cold forging. As a variant of the example shown, the body housing 1 may be made in two parts, with a joint plane at the level of the rear end wall 2.

Figure 1:
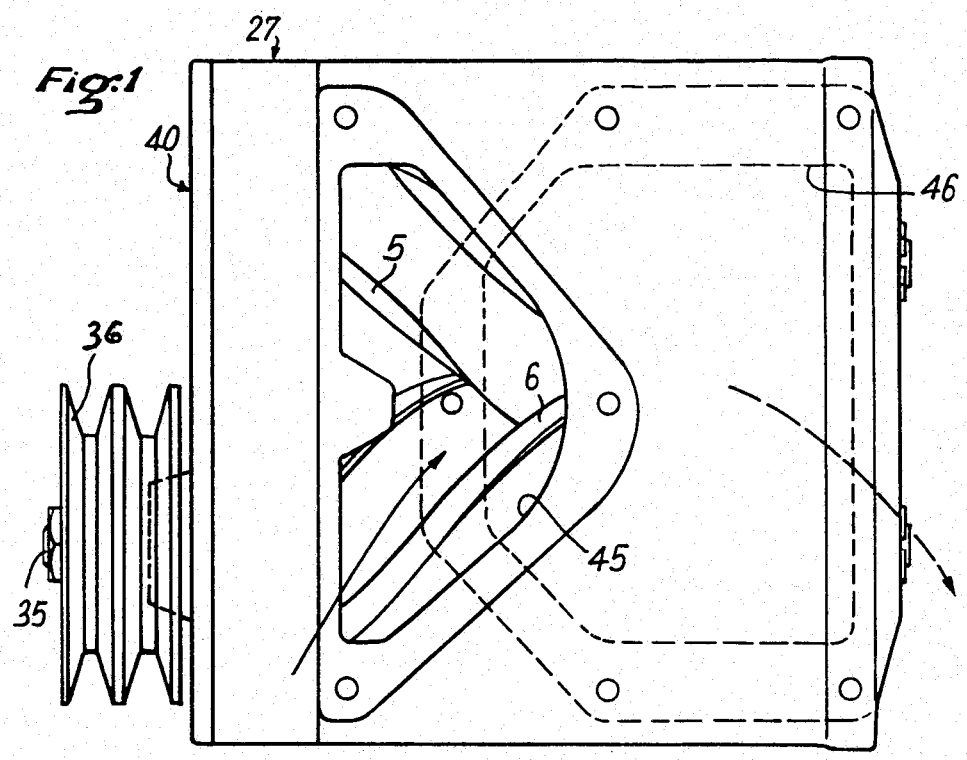
FIG. 1 is a plan view of a volumetric compressor according to the invention.
Figure 3:
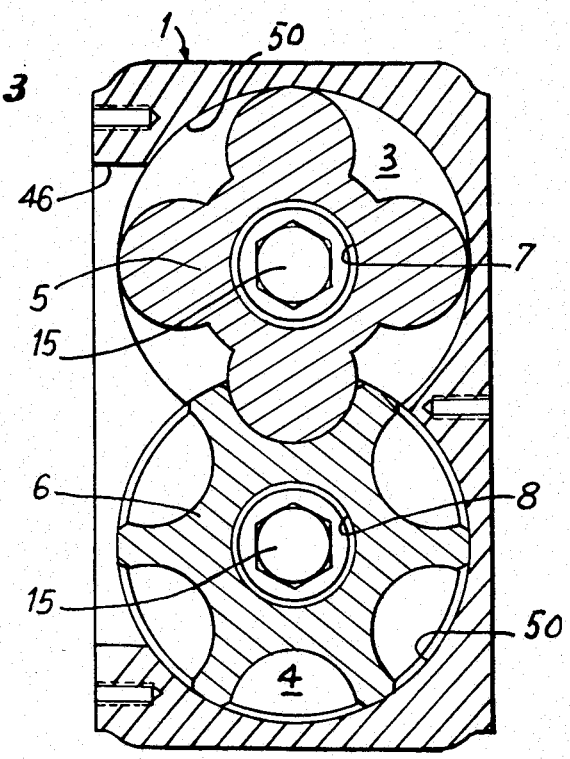
FIG. 3 is a cross-section along the line III—III in FIG. 2.

FIG. 1 shows an embodiment with the inlet port 45 and the exhaust port 46 formed in the central body housing 1, either side of the latter; as a variant, these ports may be formed in the faces of the housing or in one face and one zone of the housing 1.

The arrangement of the compressor according to the invention enables the rotor bodies 5 and 6 to be made out of light alloy, more particularly aluminum alloys and also, taking account of the class of compressor being considered, out of a rigid plastic material, for example phenolic resin or polyamide with a glass filler. The design of the shafts in two parts according to the invention also enables, in this case, the rotor bodies 5 and 6 to be made by molding directly upon the corresponding front shaft members 20 and 21, thereby ensuring strong securing between said assembly components.

According to the invention, the walls of the chambers 3, 4 as also the outer surfaces of the threads of the rotors 5 and 6 are coated, before assembly, as depicted at 50, with an overthickened layer of a coating material which is erodable by the adjacent outer surface zones of the cooperating components of the compressor. Such an arrangement makes it possible to substantially suppress the problems resulting from manufacturing tolerances when assembling the compressor, the threads of the rotors establishing by running-in their convenient path within the thickness of the erodable coating layer on the walls of the chambers and mutually the optimum cooperation between the male and female threads for obtaining automatically the convenient functional play between the rotor threads. Thus, when assembling the rotor components, the rotors are mutually imbricated and positioned in the chambers slightly in force, the first revolutions insuring the creation, by local removing of the coating material, of the necessary functional play, the convenient angular setting of the rotors being insured by the mutual coupling without angular play between the driving gears 34 and 32, 33. The erodable coating material contains particles of dry lubricant materials ensuring a smooth operation without substantial heating of the compressor operating in a dry mode. The erodable coating material may be composed of a combination of a resin, a binder dissolved in a volatile solvent and particles of graphite and/or of molybdenum bisulphide, the coating layer being applied by immersion, painting or spraying.

Although the present invention has been described with reference to particular embodiments, it is not limited by them, but on the contrary it is capable of modifications and of variants which will be apparent to those skilled in the art.

We claim:

1. A screw compressor, comprising a male rotor and a female rotor respectively arranged within two intercommunicating parallel cylindrical chambers formed in a housing and closed, at their opposite axial ends, by a rear end wall and a front bulkhead, each rotor being supported and rotatingly driven by a shaft means including a first shaft end extending through said front bulkhead, said first shaft ends being provided with meshing toothed wheels for synchronously driving said rotors, each said first shaft end extending within a recess formed in the corresponding rotor and being coupled for rotation therewith within said recess, characterized in that each rotor includes a hub having a longitudinally extending transversing internal space, each said shaft means comprising a rear bearing assembly received within the corresponding end portion of said internal space and sealingly mounted on a rear shaft member fixed to said rear end wall, and a front shaft member forming said first shaft end secured to the corresponding rotor and cooperating with an annular seal received within a tubular portion of said front bulkhead which extends into said front end portion of said internal traversing space.

2. A screw compressor according to claim 1, characterized in that said front shaft member of said female rotor is provided with means for coupling to a driving unit for driving the compressor.

3. A screw compressor according to claim 2, characterized in that said front shaft member of said male rotor carries two coaxial pitch adjustable toothed wheels in meshing engagement with a toothed wheel carried by said front shaft member of said female rotor.

4. A screw compressor according to claim 1, characterized in that both rotors are made out of rigid plastic material.

5. A screw compressor according to claim 1, characterized in that each said rotor is molded into the respective front shaft member.

6. A screw compressor according to claim 1, characterized in that each said rear shaft member is fixed to said rear end wall by a central screw.

7. A screw compressor according to claim 1, characterized in that at least said chambers have their inner walls coated with an overthickened layer of erodable coating material containing particles of at least one dry lubricant material.

8. A screw compressor comprising a male rotor and a female rotor having cooperating threads respectively housed in two parallel intercommunicating chambers formed in a housing having inner walls and closed, at their opposite axial ends, by a rear end wall and a front end wall, respectively, each rotor being supported and driven in rotation by shaft means comprising a first shaft end extending through said front end wall, said first shaft ends being provided with meshing toothed wheels for synchronous driving of said rotors, characterized in that at least said inner walls of said chambers are coated with an overthickened layer of an erodable coating material containing particles of dry lubricant material, said driving toothed wheels being meshingly coupled without angular play.

9. A screw compressor according to claim 8, characterized in that the outer surfaces of said rotor threads are coated with an overthickened layer of said erodable coating material.

10. A screw compressor according to claim 8, characterized in that said first shaft end of one of said rotors carries two coaxial pitch adjustable toothed wheels in meshing engagement with a toothed wheel carried by the first shaft end of the other of said rotors.

11. A screw compressor according to claim 8, characterized in that said erodable coating material contains graphite particles.

12. A screw compressor according to claim 8, characterized in that said shaft means of each said rotor comprises a first shaft member journalled within said front end wall and having an inner end portion secured into an axially extending recess formed centrally in said rotor.

13. A screw compressor according to claim 12, characterized in that said front shaft member of said female rotor comprises coupling means for coupling the compressor to a prime mover.

* * * * *